US006074292A

United States Patent [19]

Gilday

[11] Patent Number: 6,074,292

[45] Date of Patent: Jun. 13, 2000

[54] COMPOUNDING, GLAZING, OR POLISHING PAD WITH VACUUM ACTION

[76] Inventor: Mark Byron Gilday, 25870 W. Hermann Ave., Antioch, Ill. 60002

[21] Appl. No.: 09/092,207

[22] Filed: Jun. 5, 1998

[51] Int. Cl.[7] ..... B24D 11/02

[52] U.S. Cl. ..... 451/533; 456/359

[58] Field of Search ..... 51/297, 298; 451/533, 451/526, 538, 539, 456, 359

[56] References Cited

U.S. PATENT DOCUMENTS

| | | | |
|---|---|---|---|
| Re. 32,978 | 7/1989 | Demetriades | 451/533 X |
| Re. 35,021 | 8/1995 | Englund et al. | 451/533 X |
| 4,185,046 | 1/1980 | Pengilly et al. . | |
| 4,263,755 | 4/1981 | Globus | 451/538 X |
| 4,617,767 | 10/1986 | Ali | 451/538 X |
| 4,962,562 | 10/1990 | Englund et al. | 451/533 X |
| 5,383,309 | 1/1995 | Sampietro | 451/533 |
| 5,579,554 | 12/1996 | Plazanet | 451/359 X |
| 5,607,345 | 3/1997 | Barry et al. | 451/538 X |
| 5,725,423 | 3/1998 | Barry et al. | 451/538 X |
| 5,775,984 | 7/1998 | Olson et al. | 451/533 X |

*Primary Examiner*—Timothy V. Eley

[57] ABSTRACT

A pad for applying compounds or glazes to painted surfaces, as well as other surfaces, comprised of a layer of polymeric reticulated open cell flexible polyester urethane foam wherein a centrally located cut out is made in this layer of foam; a layer of non-porous, heat activated polyester film adhesive; and a layer of looped fabric backing material for means of attachment to a back up pad which is rotated by a drive motor, at a speed in the range of 1,000–3,000 R.P.M., as well as to facilitate the ease in changing of such pads. The pad design, when combined with the rotation of such pad, provides for a vacuum action which draws the debris created by the polishing process, as well as air to the centrally located cut out area. The air is then drawn through the open cells of the reticulated polyester urethane foam and disbursed out the side of such pad, thus alleviating some of the heat build up associated with the polishing process. This pad significantly decreases smearing and swirl marks, and also greatly increases the usable working surface area for the purpose of which pads were intended, and significantly increases the pad's longevity/durability, and makes the polishing process easier and faster for the operator.

4 Claims, 2 Drawing Sheets

COMPOUNDING, GLAZING, OR POLISHING PAD WITH VACUUM ACTION

BACKGROUND OF THE INVENTION

This invention relates to compounding, and glazing or polishing pads which are used to finish/refinish exposed paint surfaces on automobiles (particularly with regard to the paint type called basecoat/clearcoat, but as not to exclude other types of paint) as well as other products. These pads are of the type that are releasably attached to a back up pad which is rotated by a drive motor (commonly referred to as a buffing machine or polisher), which operates at a typical speed in the range of 1,000–3,000 R.P.M.

In the steps of the paint finishing/refinishing process, whether it is new paint, or paint that has been exposed to the elements (weathered), sanding with fine grit abrasive (e.g., 600–2000 grit) is sometimes necessary to level the surface or remove imperfections. This sanding process leaves scratches in the paint surface. Typically, lambswool or open cell foam compounding pads are used to apply compound to remove surface scratches caused by sanding. Foam compounding pads generally are comprised of polymeric reticulated open cell flexible polyester urethane foam with open cells of approximately 50 P.P.I. (pores per inch). After the compounding process, typically there are still finer scratches in the paint surface. These scratches are generally referred to as swirl (or wheel) marks. Typically, the final step of the process is to go over these scratches with a less abrasive or non-abrasive glazing compound applied with either a finer lambswool pad or a foam polishing or glazing pad. These foam polishing or glazing pads generally are comprised of polymeric reticulated open cell flexible polyester urethane foam with open cells of approximately 80 P.P.I.

Two basic types of foam pads with different front surfaces are commonly in use (the front surface referring to the surface of the pad which actually comes in contact with the surface to be polished). One type has a front surface that is generally planar (e.g., Refer to U.S. Pat. No. 3,418,675). This type of pad is herein after referred to as a "traditional flat pad". The other type has a front surface that has a similar appearance to an "egg crate" design (e.g., Refer to U.S. Pat. Nos. 4,962,562, 5,007,128, 5,185,964, 5,396,737, and Re. 35,021). This type of pad is herein after referred to as a "convoluted pad". Both of these pads are of the type that are rotated by a drive motor, at a typical speed in the range of 1,000–3,000 R.P.M.

In a trial referred to in U.S. Pat. Nos. 4,962,562, 5,007,128, 5,185,964, 5,396,737, and Re. 35,021, whereby test panels were painted with black paint of the basecoat/clearcoat type, and when "Imperial", a machine glaze available from Minnesota Mining and Manufacturing Company, "3M", of St. Paul, Minn., was used, and whereby the performance of the "traditional flat pad" was evaluated for the purpose of removing wheel marks, the results of said trial reflected "long working time apparently because of low absorbency of the foam pads. Also, such foam pads have the tendency to sling glaze onto the adjacent area which may have already been finished. Build up of dried glaze on the surface of the foam pad can be deposited on the paint surface, resulting in a smear on that surface; and when the painted surface is almost dry and the final gloss is near, such foam pads have the tendency to grab the paint surface which causes vibration or chatter and operator fatigue".

In a trial (such as described in the immediately preceding paragraph) test results were produced using a traditional flat type pad of the type described in U.S. Pat. No. 3,418,675, and using a convoluted foam pad of the type described in U.S. Pat. No. 4,962,562, and Re. 35,021; using a machine glaze, and using test panels coated with black paint of the basecoat/clearcoat type. Results of the trial of the traditional flat pads were similar to the results reflected in the immediately preceding paragraph, with the exception of the "long working time", which was apparently not due to the low absorbency of the pad, but most likely due to the build up of debris in the center area of the pad. Apparently this build up of debris (comprised of removed paint, compound, particles of foam from the pad, and other foreign substances which may have been on the surface of the paint) caused additional friction and heat, resulting in smearing, vibration or chatter, and necessitated additional time being spent to complete the task. The results of the trial using the convoluted pads also presented limitations, including long working time, a tendency to sling glaze on adjacent areas, and a build up of debris on the elevated surfaces of the foam projections. Apparently, this build up of debris created additional friction and heat resulting in smearing. Also, with respect to the convoluted pad, another limitation noted was durability. When the convoluted pad surface is new, there is already a greatly reduced working surface area in comparison to the full surface of traditional flat pads (with the convoluted pad, it is just the ends of the projections that provide the working surface). During the course of the trial, several of the foam projecting portions of the convoluted pads wore off during use, creating even less of a working surface left on the pad. When this occurred, smearing increased dramatically, which ended the pad's useful life, significantly sooner than traditional flat pads.

BRIEF SUMMARY OF THE INVENTION

The present invention provides for new flat type foam pads which are used to finish/refinish exposed paint surfaces on automobiles (particularly with regard to the paint type called basecoat/clearcoat, but as not to exclude other types of paint), but not to be limited to use on automobiles, nor limited to painted surfaces. These pads are machine driven and used with commercially available compounds and glazes. On the front surface (the surface that actually contacts the surface to be polished), the pad is planar and has a centrally located cut-out in the polymeric reticulated open cell flexible polyester urethane foam layer having a central axis. The rear surface (the side that releasably attaches to the backing plate which is rotated by the drive motor) is generally planar. The pad also has a layer of non porous, heat activated, polyester film adhesive which provides an air and liquid tight barrier between the foam pad and the looped fabric backing material, as well as providing a means to attach the looped fabric backing material to the foam pad. By the rotation of the pad during use, and the nature of the foam, the design provides for "vacuum action" which draws air and debris created in the polishing process into the centrally located cut-out area of the foam layer. The centrally located cut-out in the foam layer also allows the air to be drawn through the pad along the central axis of the foam layer and to come in contact with the layer of adhesive which completely covers the cut-out. and subsequently out of the sides of the polymeric reticulated open cell flexible polyester urethane foam layer in a direction generally perpendicular to the central axis, which alleviates some of the heat build up associated with the polishing process. When compared to both types of foam pads described heretofore, this invention significantly reduces slinging of the compounds or glazes, working time, smearing, and heat build up. With reference to traditional flat pads, it provides a more efficient working surface due to less build up of debris created in the polishing process. With reference to convoluted foam pads, it greatly increases the usable working surface area for the purpose of which such pads were intended, and significantly increases the pad longevity, durability, and makes the polishing process easier for the operator.

BRIEF DESCRIPTION OF REFERENCE NUMERALS

Figure 1:
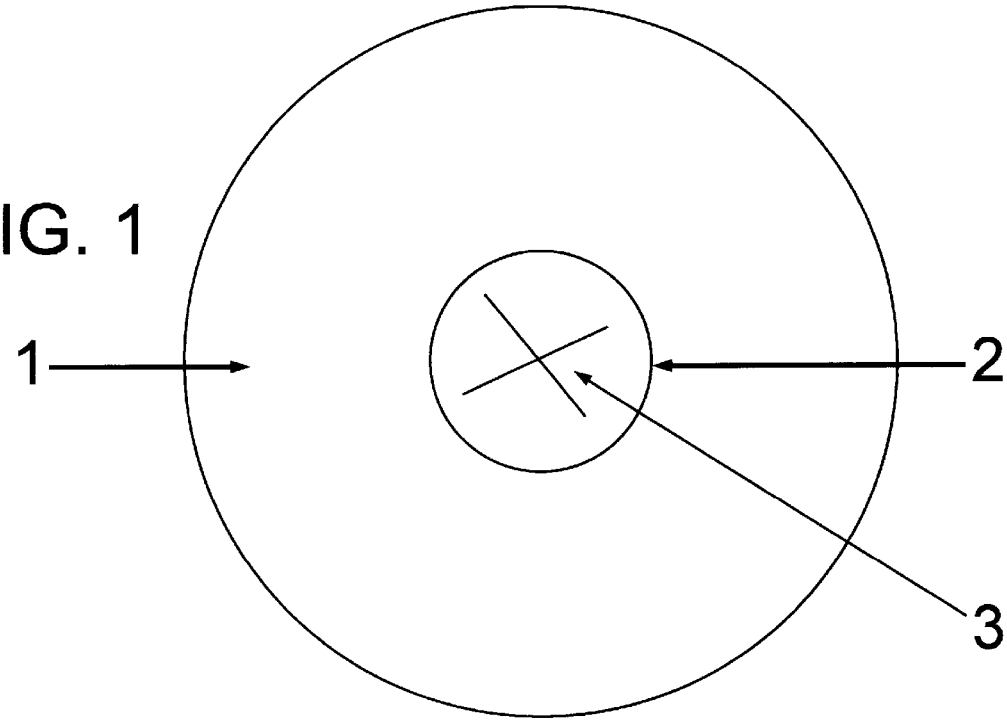
FIG. 1 is a planar view of the front surface of the foam pad.
Figure 2:
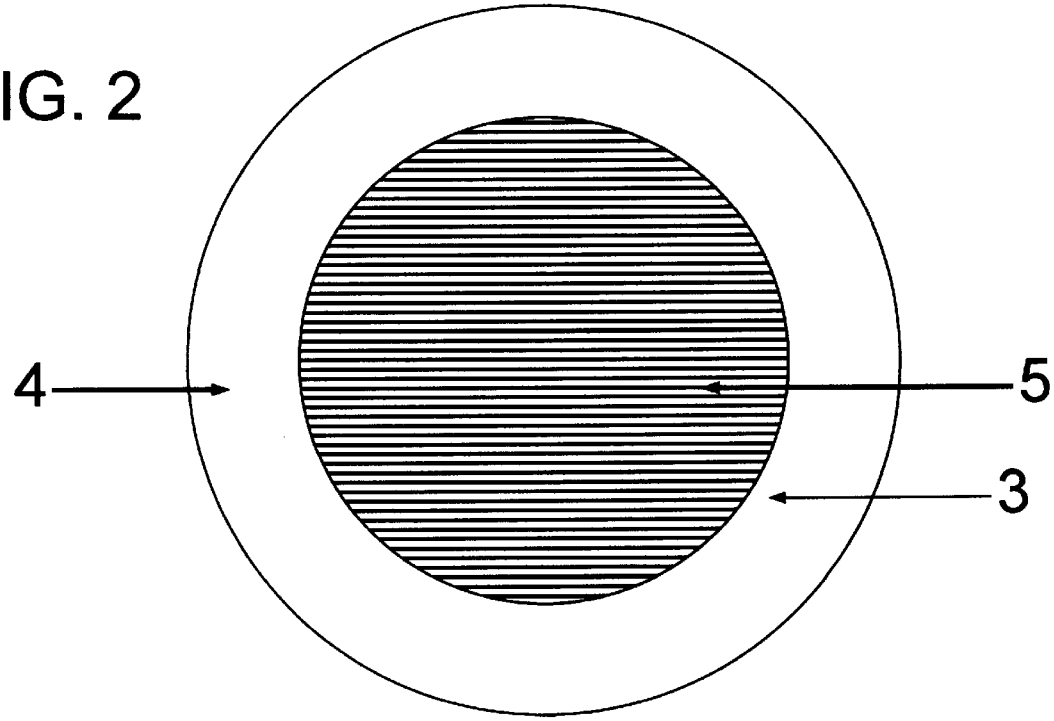
FIG. 2 is a planar view of the rear surface of the foam pad.
Figure 3:
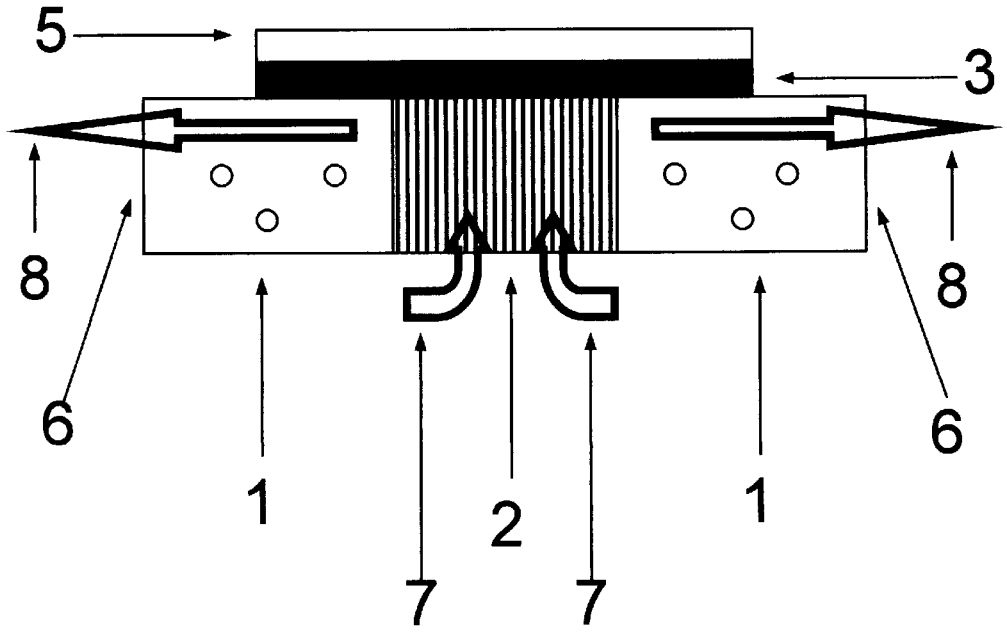
FIG. 3 is a cross section view of the foam pad.

#1—Representative of the front planar surface of the polymeric reticulated open cell flexible polyester urethane foam pad.

#2—Representative of the centrally located cut-out in the polymeric reticulated open cell flexible polyester urethane foam pad.

#3—Representative of the layer of non-porous, heat activated, polyester film adhesive applied between the layer of foam and the layer of looped fabric backing material.

#4—Representative of the rear surface of the polymeric reticulated open cell flexible polyester urethane foam pad.

#5—Representative of the layer of looped fabric backing material to facilitate the changeability of the pad.

#6—Representative of the outside die cut edge of the polymeric reticulated open cell flexible polyester urethane foam layer.

#7—Representative of air and/or debris created in the polishing process being drawn into the centrally located cut-out in the polymeric reticulated open cell flexible polyester urethane foam layer.

#8—Representative of the air being drawn through and subsequently out of the polymeric reticulated open cell flexible polyester urethane foam pad.

DETAILED DESCRIPTION OF THE INVENTION

This invention relates to the pads which are used to finish/refinish exposed paint surfaces (particularly with regard to the paint type called basecoat/clearcoat, but not to exclude other types of paint or surfaces) on automobiles, but not to be limited to the use on automobiles.

The pad is comprised of a layer of 1.9 pounds per cubic foot density (nominal), polymeric reticulated open cell flexible polyester urethane foam, SIF-Z (thermo reticulation), 50–80 P.P.I. (the lower range of P.P.I. would be used for heavier compounding, whereas the higher range of P.P.I. would be used for glazing or polishing), which is commercially available from Foamex, L.P. of Fort Wayne, Indiana. Both front surface 1 and rear surface 4 of the layer are planar. The layer has a diameter of 8 inches, but so as not to exclude other diameters, and thickness measuring ⅞ of an inch, but so as not to exclude other thicknesses.

The pad is die cut round, with a centrally located round cut out or opening 2, extending through the layer from the front surface to the back surface and along central axis thereof, but not to exclude other configurations of the central cut out, in the polymeric reticulated open cell flexible polyester urethane foam layer only (cut out does not go through either the non-porous, heat activated, polyester film adhesive 3 or the looped fabric backing layer 5) and is directly proportionate to the overall diameter of the pad (e.g., a 2½ inch cut out in a 8 inch diameter pad) for the purpose of collection of debris and excess liquids, compounds, etc., as well as to alleviate some of the heat associated with the polishing process (not to be confused with smaller holes that were formerly placed in pads for the purpose of bolting the pad to a back up pad for certain rotational drive units).

The pad has a means for attaching the rear surface 4 of the pad to a support surface on a back up pad of a rotational drive unit by means of a looped fabric backing material 5, which is commercially available, in order to facilitate the ease in changing of such pad. The diameter of the looped fabric backing material 5 is directly proportionate to the diameter of the pad (e.g. an 8 inch pad would have a 5½ inch diameter looped fabric backing material affixed to it).

A layer of non-porous, heat activated, polyester film adhesive 3 (e.g., Bostik 10-302-5 thickness of 5 mil. thermoplastic linear saturated polyester film adhesive commercially available from Bostik of Middleton, Mass.) is affixed between the polymeric reticulated open cell flexible polyester urethane foam layer and the looped fabric backing material 5 by means of heat application for 60 seconds, at 300° (±5°), and using 80 pounds of pressure. This layer of non porous, heat activated, polyester film adhesive 3 serves two purposes. The first is as a means of attaching the looped fabric backing material 5 to the polymeric reticulated open cell flexible polyester urethane foam. The second is to form a liquid and air tight barrier between the foam and the looped fabric backing material 5.

The nature of the polymeric reticulated open cell flexible polyester urethane foam, in conjunction with the centrally located cut out 2; the non-porous, heat activated, polyester film adhesive which forms the air and liquid tight barrier between the polymeric reticulated open cell flexible polyester urethane foam and the looped fabric backing material 5; the difference in the diameter of the polymeric reticulated open cell flexible polyester urethane foam and the looped fabric backing material 5; and the rotation of the pad on a rotational drive motor unit, provides for air flow through the pad. The combination of this design and the rotation of the pad causes the outside cut edge to draw air 7 from the centrally located cut out 2 in the polymeric reticulated open cell flexible polyester urethane foam; through the pad and subsequently out 8 of the sides 6 of the polymeric reticulated open cell flexible polyester urethane foam layer, which alleviates some of the heat build up associated with the polishing process.

I claim:

1. A pad for applying compounds to surfaces, comprising a layer of polymeric reticulated open cell flexible polyester urethane foam, said layer having a central axis, a front surface, a back surface, and a central cut-out which creates an opening extending through said layer from the front surface to the back surface thereof and along said central axis; a layer of looped fabric backing material; and a layer of non-porous, heat activated polyester film adhesive; wherein the layer of non-porous, heat activated polyester film adhesive is disposed between the layer of looped fabric backing material and the layer of polymeric reticulated open cell flexible polyester urethane foam and completely covers said central cut-out, whereby the layer of the looped fabric backing material is attached to the back surface of the layer of polymeric reticulated open cell flexible polyester urethane foam, and air when drawn into said cut-out substantially along the central axis of the layer of polymeric reticulated open cell flexible polyester urethane foam comes in contact with the layer of non-porous, heat activated polyester film adhesive and passes outwardly through the layer of polymeric reticulated open cell flexible polyester urethane foam in a direction generally perpendicular to the central axis.

2. The pad as claimed in claim 1, wherein the pad is generally round, the layer of polymeric reticulated open cell flexible polyester urethane foam comprises a layer of 1.9 pounds per cubic foot nominal density, 50–80 P.P.I., and is ⅞ inch thick, and the front and back surfaces are generally planar.

3. The pad as claimed in claim 1, wherein the non-porous, heat activated polyester film adhesive forms a liquid and air tight barrier between the polymeric reticulated open cell flexible polyester urethane foam and the looped fabric backing material.

4. The pad as claimed in claim 1, wherein the central cut-out is circular.

* * * * *